US007409782B2

(12) United States Patent
Larson et al.

(10) Patent No.: US 7,409,782 B2
(45) Date of Patent: Aug. 12, 2008

(54) ANTI-SLIP OVERSHOE

(76) Inventors: Jon C. Larson, 1401 Dyke Ave., Grand Forks, ND (US) 58208; Van B. Larson, 513 6th St. South, Grand Forks, ND (US) 58201

( * ) Notice: Subject to any disclaimer, the term of this patent is extended or adjusted under 35 U.S.C. 154(b) by 547 days.

(21) Appl. No.: 11/061,036

(22) Filed: Feb. 18, 2005

(65) Prior Publication Data

US 2005/0198860 A1 Sep. 15, 2005

Related U.S. Application Data

(60) Provisional application No. 60/545,603, filed on Feb. 18, 2004.

(51) Int. Cl.
*A43B 3/16* (2006.01)

(52) U.S. Cl. ..... 36/59 R; 36/7.6; 36/7.3

(58) Field of Classification Search ..... 36/59 R, 36/7.3, 7.6, 7.11, 124
See application file for complete search history.

(56) References Cited

U.S. PATENT DOCUMENTS

| | | | | |
|---|---|---|---|---|
| 4,924,608 A | | 5/1990 | Mogonye | |
| 5,150,536 A | | 9/1992 | Strong | |
| 5,315,767 A | * | 5/1994 | Bradbury | 36/7.1 R |
| 5,317,768 A | * | 6/1994 | Klancnik | 5/736 |
| 5,553,399 A | | 9/1996 | Strong | |
| 5,659,978 A | * | 8/1997 | Bell et al. | 36/7.6 |
| 5,689,901 A | * | 11/1997 | Bell et al. | 36/7.6 |
| 5,813,143 A | | 9/1998 | Bell et al. | |
| 5,836,090 A | | 11/1998 | Smith | |
| 5,909,945 A | * | 6/1999 | Noy | 36/7.6 |
| 5,921,005 A | | 7/1999 | Bell et al. | |
| 5,966,840 A | | 10/1999 | Bell et al. | |
| 5,972,463 A | | 10/1999 | Martin et al. | |
| 6,154,982 A | | 12/2000 | Bell et al. | |
| 6,836,977 B2 | * | 1/2005 | Larson et al. | 36/59 R |
| 2003/0154626 A1 | | 8/2003 | Larson et al. | |

OTHER PUBLICATIONS

Gripper for Strippers™ Non-Scratching High Traction™ Footwear, Jordan David High Traction Footwear, 2 pages, Jan. 14, 2005.

* cited by examiner

*Primary Examiner*—Jila M Mohandesi
(74) *Attorney, Agent, or Firm*—Robert D. Atkins; Quarles & Brady LLP

(57) ABSTRACT

An anti-slip overshoe includes a contoured outer band, a gripping pad disposed interior to the contoured outer band for providing traction, and a web structure connecting the gripping pad to the contoured outer band. The gripping pad can include gripping ridges for providing traction. The gripping pad can include ridge spaces for providing traction. The gripping pad can include removable grip devices for providing traction. A method of making an ant-slip overshoe includes providing a contoured outer band, providing a gripping pad disposed interior to the contoured outer band, and providing a web structure connecting the gripping pad to the contoured outer band.

25 Claims, 3 Drawing Sheets

ANTI-SLIP OVERSHOE

CLAIM TO DOMESTIC PRIORITY

The present non-provisional patent application claims priority to provisional application Ser. No. 60/545,603 entitled "Anti-slip overshoe", filed on Feb. 18, 2004, by Larson et al.

FIELD OF THE INVENTION

The present invention relates in general to shoe apparel and, more particularly, to an anti-slip overshoe.

BACKGROUND OF THE INVENTION

Shoes, including athletic shoes, work boots, dress shoes, ski boots, overshoes, and all manner of footwear, provide poor traction on many surfaces, including slippery, icy, and wet surfaces. The difficulties of moving across a slippery surface, including walking, running and jogging, result in aggravation and injury. Slips, falls and resultant injuries are typically caused by a lack of good footing.

Even if a person does not actually fall, the need to walk slowly or with small steps over a slippery surface is inconvenient, slows movement, and is a distraction that interferes with a person's ability to be aware of their surroundings and be alert to non-slip hazards.

The problems of walking on slippery surfaces interferes with business that requires outdoor work to be done when conditions are icy. Postal and parcel delivery, for instance, is hampered, as well as baggage handling, road repair, ambulance and emergency work, police work, and any outdoor work that cannot be stopped for inclement weather.

Runners, joggers and persons that exercise outdoors are hampered by the loss of traction on slippery surfaces. Even if outdoor surfaces are slightly slippery, a jogger must take smaller strides to avoid slipping. Activities that require movement faster than a slow walk are greatly hindered in inclement conditions by a lack of suitable footwear.

Further, even the knowledge that roads and sidewalks are slippery can be detrimental. The knowledge that outdoor walking conditions are hazardous may discourage persons from engaging in normal activities. For instance, a person is more likely to choose not to walk to a store, to take a pet for a walk, or otherwise leave home if the person knows that walking conditions are slippery and may lead to injury.

The problem of slippery surfaces is especially acute for the elderly or persons with disabilities that interfere with a standard gait. Many elderly persons experience impediments to walking that make the elderly person more likely to slip and fall under normal conditions; and in climates where snow and ice persists through a significant portion of the winter, some elderly persons become essentially homebound. Similarly, a disability that causes an irregular gait may discourage a person from undertaking normal activities when outdoor walkways provide sub-par traction; for example, the loss of a leg may create an irregular gait that leads to added vulnerability to slipping.

Ideally, footwear that provides good traction in all weather would minimize the inconvenience of changing or removing shoes every time a person comes indoors. Further, a device that is versatile and works with many size shoes or foot-sizes is desirable so that a user, especially an organization that serves multiple persons, may stock a minimal number.

SUMMARY OF THE INVENTION

In one embodiment, the present invention is an anti-slip overshoe for fitting over a shoe sole, comprising an outer band, a first gripping pad disposed interior to the outer band, the first gripping pad including a gripping ridge integrated in the first gripping pad for providing traction, a ridge space integrated in the first gripping pad for providing traction; and a web structure connecting the first gripping pad to the outer band.

In another embodiment, the present invention is an anti-slip overshoe for fitting over a shoe sole, comprising an outer ring structure, an inner ring structure disposed interior to the outer ring structure for providing traction, and a plurality of arms connecting the inner ring structure to the outer ring structure.

In another embodiment, the present invention is an anti-slip overshoe for fitting over a shoe sole, comprising a contoured outer band, a first gripping pad disposed interior to the contoured outer band for providing traction, and a web structure connecting the first gripping pad to the outer band.

In another embodiment, the present invention is a method of making an anti-slip overshoe for fitting over a shoe sole, comprising providing a contoured outer band, providing a first gripping pad disposed interior to the contoured outer band for providing traction, and providing a web structure connecting the first gripping pad to the outer band.

DETAILED DESCRIPTION OF THE DRAWINGS

The present invention is described in one or more embodiments in the following description with reference to the Figures, in which like numerals represent the same or similar elements. While the invention is described in terms of the best mode for achieving the invention's objectives, it will be appreciated by those skilled in the art that it is intended to cover alternatives, modifications, and equivalents as may be included within the spirit and scope of the invention as defined by the appended claims and their equivalents as supported by the following disclosure and drawings.

The footwear described below can be a device which is worn over other footwear. As a result, the footwear is referred to as an "anti-slip overshoe". An anti-slip overshoe can easily slip on and off of shoes and provides excellent grip and traction on slippery-surfaces. The improvement in grip and traction results in greater safety, efficiency, and confidence for a person moving across a surface. Walking or jogging is safer and the wearer of the overshoe may move with an increased stride length that is faster and more comfortable. Use of an anti-slip overshoe by a wearer helps to solve the difficulties previously described.

Figure 1B:
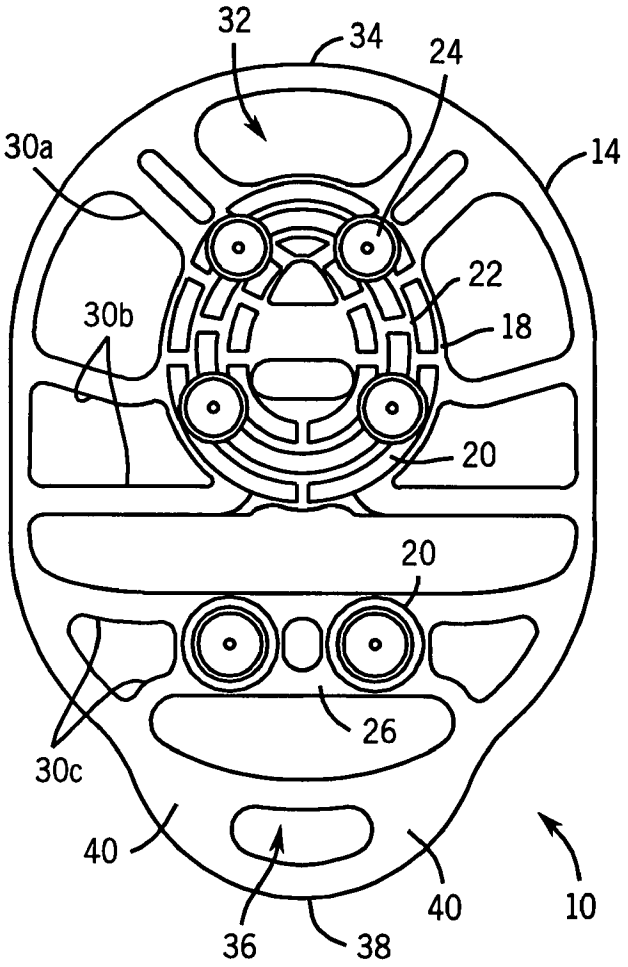
FIG. 1 illustrates a top and bottom view of an anti-slip overshoe in an unsecured state.
Figure 1A:
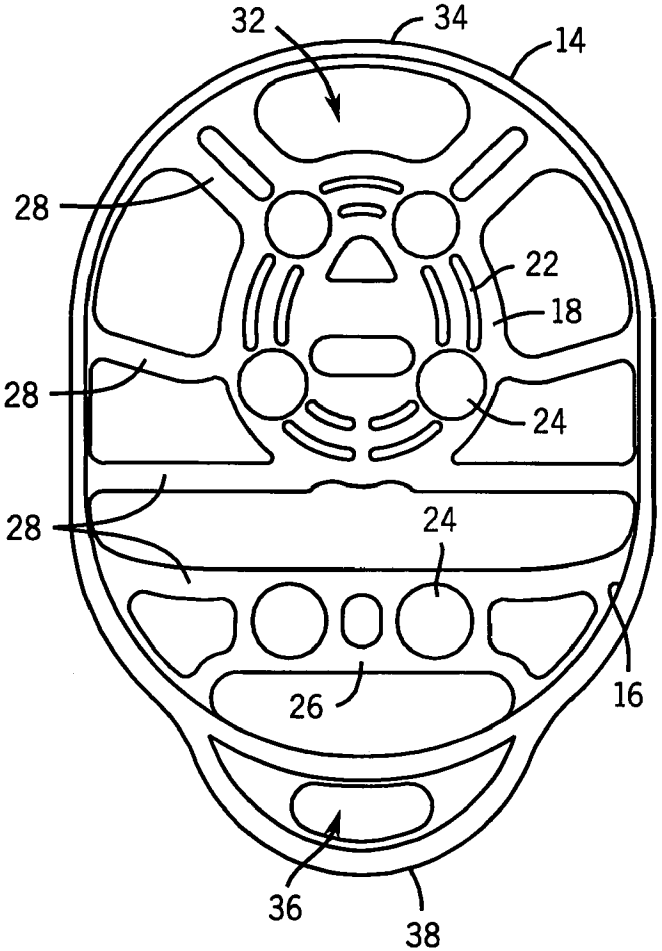

Referring to FIG. 1*a* and FIG. 1*b*, anti-slip overshoe 10 is shown in a top and bottom view, respectively. The material of overshoe 10 can be a durable elastic material that is tough, light-weight and flexible even in temperatures below 0° F. The term "elastic material" as described includes natural and synthetic polymers, including rubbers and reinforced rubbers, and other suitable materials. Overshoe 10 can be constructed using amorphous and crystalline thermoplastic resins. Overshoe 10 can be constructed using an injection molding process where hot, molten polymer is injected into a cold mold. A screw apparatus can be used to inject the polymer into the mold. After overshoe 10 cools and hardens, the mold is opened and overshoe 10 is ejected from the mold. Any resulting flashing is then removed from overshoe 10. Overshoe 10 can be constructed by using an injection molding technique that extrudes material over an existing core plate in the mold to provide a unitary construction.

The material of overshoe 10 can be formulated to allow for a certain amount of stretch, while maintaining durability and light weight. By allowing for stretch, a limited number of overshoe sizes can be provided which accommodate a larger range of shoe sizes. A small/medium size overshoe 10 can easily accommodate a range of shoe sizes from small women's shoes to medium sized men's shoes. Similarly, a large/extra large size overshoe 10 can easily accommodate a range of shoe sizes from medium sized men's shoes to much larger sized men's shoes. Essentially, two sizes of overshoe 10 can be constructed to cover the broad range of both men's and women's shoe sizes.

Overshoe 10 includes a contoured outer band or outer ring structure 14. Contoured outer band 14 can be configured to be contoured to match the shape of a shoe sole so that overshoe 10 fits snugly but is easily removable. Contoured outer band 14 can be oval-shaped, including a wider frontal portion which tapers to a more narrow heel portion. The contoured design of outer band 14 allows for the proper amount of stretch and corresponding fitment in the correct direction, toe to heel and side to side, of overshoe 10. The design of contoured outer band 14 can be well-suited for use with dress shoes, athletic footwear or other similar types of shoes including casual footwear.

Outer band 14 can have a certain amount of associated elasticity. Outer band 14 can be generally smaller than the periphery of the shoe sole in which outer band 14 accommodates. Outer band 14 can be stretched by applying tension. Upon release of tension, outer band 14 can return to the original shape of outer band 14. As a result, outer band 14 can be stretched by a user to fit around the periphery of a shoe sole. The elastic force exerted by outer band 14 provides for a snug fit that conforms to the user's shoe as overshoe 10 is frictionally held in place. Use of a contoured outer band 14 is a marked improvement over other designs which are rectangular-shaped. Rectangular designs produce non-uniform tension as they are stretched. As a result, portions of weak tension cause the overall security of an overshoe 10 as applied to a shoe sole to be lower. A rectangular design may be less of a problem where used in footwear such as an outdoor boot, where the ball and heel portions are roughly the same width. The problem becomes much more apparent when using a shoe sole with a wide ball portion which tapers to a narrow heel portion, such as dress shoes and athletic shoes. By utilizing a contoured outer band 14 which matches the overall contour of a shoe sole, the stretch in each portion of outer band 14 is uniform throughout. The forward portion of outer band 14 is held at the same tension as the side portions of outer band 14 and the rear portions of outer band 14. Overshoe 10 is then more securely held in place to a shoe sole consistently around the shoe's periphery. A wearer can feel more confident when engaged in athletic activities, such as running on slippery surfaces, that overshoe 10 is securely fastened to the shoe and will not fall off, possibly causing injury.

Outer band 14 has an associated lip 16 to facilitate snugly attaching overshoe 10 to a shoe sole. Again, outer band 14 and associated lip 16 are designed to facilitate being frictionally held in place to the outer periphery of a shoe sole. The low profile of outer band 14 is intended to enhance the traction provided by overshoe 10 while minimizing the portion of overshoe 10 that extends over an upper portion of a shoe.

Outer band 14 can serve as an anchor point for optional, removable straps which can be oriented over the upper portion of a shoe to better secure overshoe 10 to a shoe sole in cases of heavy mud, snow or other debris.

Turning again to FIG. 1, a gripping pad or inner ring structure 18 is seen. Gripping pad 18 or inner ring structure 18 can be designed in an oval, ring or egg shape to give better traction from all angles and directions when standing, walking, or running on a slippery or moving surface. In one example, inner ring structure 18 includes a series of interconnected oval rings, having an exterior ring structure connected to an interior-disposed ring structure which is connected to another interior-disposed ring structure.

Gripping pad 18 has an associated plurality of gripping ridges 20. Ridges 20 extend downwards from the bottom face of gripping pad 18 where ridges 20 engage a slippery surface. Ridges 20 can vary in height, width or depth to provide enhanced traction to a wearer. Ridges 20 grip into a slippery surface and provide traction.

Gripping pad 18 can include intermittent slits or gaps integrated in gripping pad 18, here termed ridge spaces 22. Ridge spaces 22 can allow debris (ice, snow, mud or otherwise) to dislodge from gripping pad 18. Without ridge spaces 22, a wearer could realize a buildup of debris on overshoe 10. Debris could accumulate until the benefits of additional traction provided by overshoe 10 are outweighed by the negative impact of accumulating debris. Ridge spaces 22 encourage debris to be dislodged by limiting the available surface area of contact and accumulation. When debris becomes dislodged, the surface area of gripping pad 18 is again free to make the greatest contact with a surface to ensure appropriate traction. Gripping ridges 20 can also include gaps integrated into gripping ridges 20 which allow for less debris to accumulate on overshoe 10. Further, gripping ridges 20 may have a series of two outer ridges with an inner trough structure which is designed to also discourage debris accumulation and channel away moisture.

Examining the top view of overshoe 10, gripping pad 18 has a smooth, flat surface as opposed to the integrated ridges 20 seen in the bottom view. A smooth, flat surface is intended to allow for maximum surface area contact with the bottom portion of a shoe sole.

Overshoe 10 can include grip devices 24, such as spikes, that help the wearer have grip and traction on a surface. In the case of an overshoe 10 having grip devices 24, the weight of the wearer pushes the grip devices 24 into the surface so that grip devices 24 grip and provide additional traction. As shown in FIG. 1, gripping pad 18 includes removable grip devices 24. In one example, grip devices 24 are inserted in a receiving bore located in gripping pad 18. Grip devices 24 can include any device which is intended to enhance traction, such as spike devices. Spikes, in turn, could be made of any durable material—for instance, carbide—which resists wear and maintains a sharp point, stainless steel or even spark resistant copper for a particular application.

Grip devices 24 may also include a hard plastic apparatus or a non-slip material such as a fibrous polyvinylchloride (PVC) loop material or similar material for enhancing traction in a particular situation, such as oily surfaces, tile surfaces, or hazardous surfaces such as caustic or similar surfaces.

Overshoe 10 and gripping pad 18 can have grip devices 24 that help the wearer have grip and traction on a surface. The weight of a wearer pushes the grip devices 24 into the surface so that grip devices 24 grip the surface. Grip devices 24 can be arranged to seat in the forward and rearward portions of gripping pad 18. Grip devices can be arranged so that the ball of the foot pushes grip devices 24 into the surface while walking. The forwardmost grip device 24 is pushed into the surface when the wearer's weight is shifted to the far forward—for example when running, standing on tip-toe, or leaning back with the toes pointed—a position that is naturally assumed in some situations, for instance when leaning far back while pulling a rope tied to a heavy object.

Grip devices 24 can be readily removed from overshoe 10 for use on surfaces that might be damaged by grip devices 24. Readily removing grip devices 24 facilitates worn grip device 24 replacement, and is a safety feature that, for instance, allows a user to be freed when a grip device 24 is inadvertently wedged in a crevice in a rigid surface. Overshoe 10 has gripping features in addition to grip devices 24. A user may wear overshoe 10 without grip devices 24 and enjoy greatly increased traction, although maximum traction on ice can be achieved with use of spikes as grip devices 24. Removing grip devices 24 can be particularly useful when overshoe 10 is worn indoors as many household surfaces would be damaged by spikes or other sharp grip devices 24.

Instead of grip devices 24 being placed in a receiving bore integrated in gripping pad 18, a wearer can take advantage of ridge spaces 22 to attach various non-slip materials as grip devices 24 to overshoe 10. For example, a strap which includes non-slip material may be weaved through ridge spaces 22 and act as grip device 24 for a particular application, such as tile or granite surfaces, oily or caustic surfaces. Outer band 14 can also anchor optional non-slip material which may be attached to the bottom of overshoe 10.

Referring again to FIG. 1, a second gripping pad 26 is shown located at approximately the heel region of overshoe 10. Gripping pad 26 can include gripping ridges 20 which can be similar in varying height, width or depth to those found in first gripping pad 18. Again, ridges 20 are intended to enhance traction. Here, as above, ridges 20 can have one or more individual ridge structures which are interspaced with trough structures, gaps or spaces to channel moisture away from gripping pad 26 and discourage debris accumulation.

Second gripping pad 26 can also have associated grip devices 24, which again can be spikes or other non-slip materials or devices. Grip devices 24 located in second gripping pad 26 provide additional traction when a wearer exerts pressure on the heel portion of a shoe. First gripping pad 18 and second gripping pad 26 can work together to provide traction at both ball and heel portions of a wearer's step, ensuring that adequate traction is provided at all phases of a wearer's gait.

Overshoe 10 includes web structure 28 which connects first gripping pad 18 and second gripping pad 26 to contoured outer band 14. Web structure 28 can include a plurality of arms or other connecting mechanisms to securely connect first gripping pad 18 and second gripping pad 26 to contoured outer band 14. Overshoe 10 can include a pair of front arms 30*a*, a pair of intermediate arms 30*b* and a pair of rear arms 30*c* that combine to form web structure 28.

The material of web structure 28 can be formulated to allow for a certain degree of stretch and elasticity. Web structure 28 can stretch in response to tension being applied to overshoe 10. Once tension is released, web structure 28 can then return to the original state of web structure 28.

The forward region formed between contoured outer band 14, first gripping pad 18 and web structure 28 can have an opening termed toe area 32. Toe area 32 can have an associated toe portion 34 of contoured outer band 14. Once overshoe 10 is placed over existing footwear, toe portion 34 can securely rest over the front welt of the footwear. Toe portion 34 can also be pulled over the toe of footwear to further secure overshoe 10 to the footwear.

As seen in FIG. 1, front arms 30*a* can include a set of two closely-connected subparts. Using two subparts can better secure overshoe 10 in the forward toe area and accommodate enhanced pressure exerted on the forward part of footwear when walking or running.

The rearward region formed between contoured outer band 14, second gripping pad 24 and web structure 28 also forms an associated opening termed heel area 36. Heel area 36 can have an associated heel portion 38 of contoured outer band 14. The opening of heel area 36 allows a wearer's finger or fingers to slip through, effectively forming a grasping point or handle for a wearer to pull the rear portion of overshoe 10 over the periphery of a footwear heel and further up the footwear heel to adequately secure overshoe 10 to the footwear heel.

Heel portion 38 can have two connecting molded straps 40 which are flat. Flat straps 40 allow for a more secure fit against the flat surface of a footwear heel. A rounded connecting strap 40 might have a tendency to roll off a footwear heel when placed under tensile forces. Use of flat straps 40 allow for the greatest surface area contact, enhancing the security of heel area 36 and heel portion 38 to the rear portion of a shoe sole.

Because of the elasticity and deformability associated with web structure 28 and contoured outer band 14, overshoe 10 can take on a virtually flat, two-dimensional form when not in use. Having a virtually flat form is attractive for storage purposes, as a number of stored overshoes 10 can be placed in a relatively small storage space.

Figure 2:
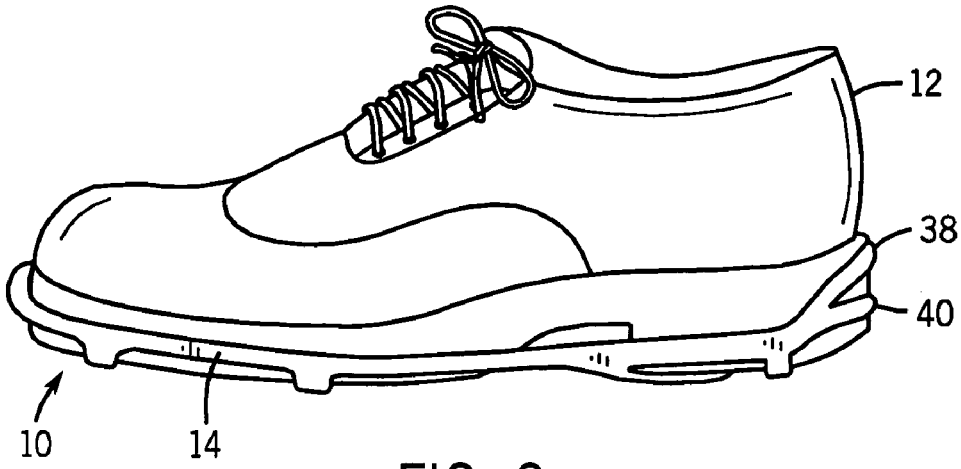
FIG. 2 illustrates a side view of an anti-slip overshoe secured to the sole of a dress shoe.

FIGS. 2, 3, 4 and 5, following, depict overshoe 10 in a secured position over a shoe sole. Turning to FIG. 2, overshoe 10 is seen accommodating a dress shoe 12. To use overshoe 10, a wearer places overshoe 10 in an orientation where grip devices 24 and ridges 20 point away from shoe 12. Toe area 32 is oriented towards the toe of shoe 12. Toe portion 34 is placed over the front welt of shoe 12. Contoured outer band 14 is oriented around the front and side portions of the periphery of the sole of shoe 12. Orienting contoured outer band 14 causes web structure 28 to flex to allow outer band 14 to fit over the periphery of the sole of shoe 12. To finish securing overshoe 10 to shoe 12, the opening in heel area 36 is grasped by a wearer. The wearer urges heel area 36 and associated heel portion 38 away from the front of the shoe 12 to cause outer band 14 to stretch until heel area 36 and heel portion 38 can be moved into a secure position that is behind the rear of the sole of shoe 12. The elastic nature of overshoe 10 maintains overshoe 10 in a substantially stationary position with respect to the shoe 12.

Figure 3:
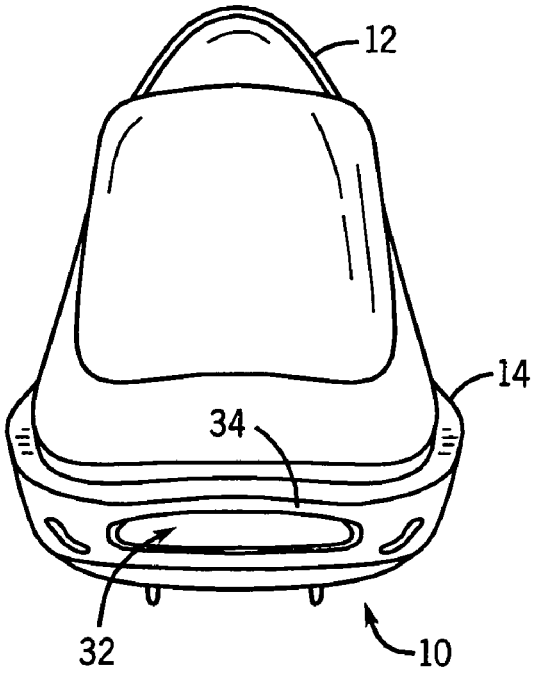
FIG. 3 illustrates a front view of an anti-slip overshoe secured to the sole of a dress shoe.

Returning to FIG. 2, flat connecting straps 40 are seen providing surface area support to overshoe 10 in the heel area of shoe 12. Turning to FIG. 3, a front view of a secured overshoe 10 secured to another dress shoe 12 is shown. Here, toe area 34 and associated toe portion 34 are seen covering the front welt of shoe 12. Here again, outer band 14 does not extend above the sole of shoe 12. Having outer band 14 not extend above the sole of shoe 12 enables a person wearing overshoe 10 to enjoy the benefits of added traction while the appearance of an upper portion of shoe 12 remains substantially unchanged.

Figure 4:
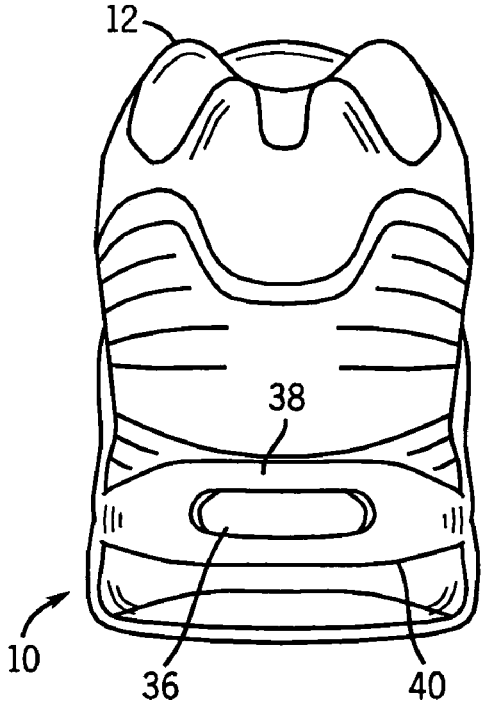
FIG. 4 illustrates a back view of an anti-slip overshoe secured to an athletic shoe sole.
Figure 5:
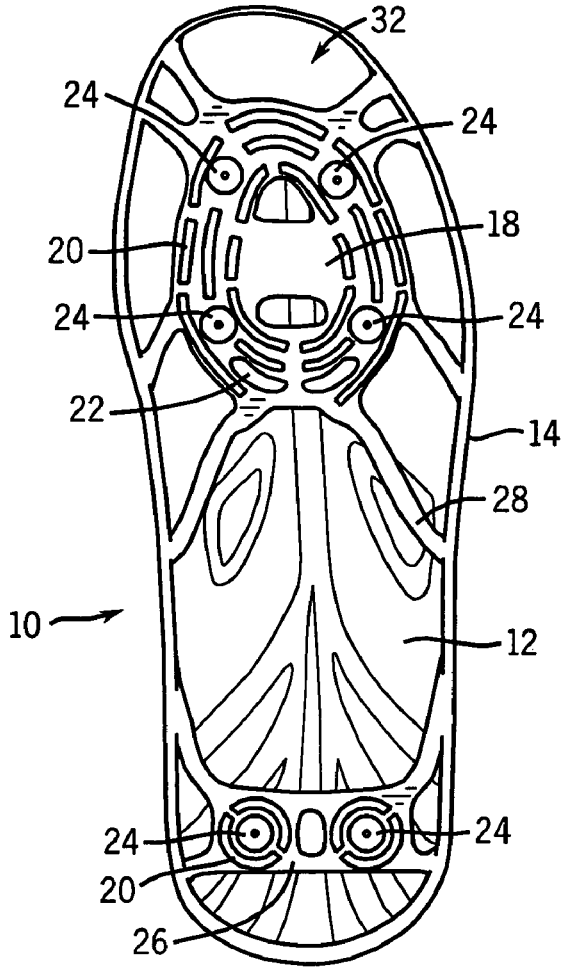
FIG. 5 illustrates a bottom view of an anti-slip overshoe secured to an athletic shoe sole.

Turning to FIG. 4, a back view of a secured overshoe 10 to athletic shoe 12 is depicted. Again, flat connecting straps 40 provide additional support to adequately secure heel area 36 and heel portion 38 to the heel of shoe 12. FIG. 5 depicts a bottom view of overshoe 10 in a secured position over the sole of shoe 12. Contoured outer band 14 is seen, stretched to fit around the periphery of shoe 12. First gripping pad 18 is again seen, located at approximately the ball portion of shoe 12. Overshoe 10 can be designed such that the overall form of gripping pad 18 does not generally change, even when secured in position. As shown in FIG. 5, the bulk of stretch that occurs in overshoe 10 is performed by outer band 14 in conjunction with web structure 28. The plurality of arms that make up web structure 28 stretch appropriately to accommodate the respective size of shoe 10, while the basic size and form of gripping pad 18 remain substantially unchanged. Web structure 28 appropriately stretches on both left and right sides to ensure that gripping pad 18 is centered properly.

Again, referring to FIG. 5, ridges 20 and associated ridge spaces are shown integrated in gripping pad 18. Grip devices 24 are shown, which again are removable spike devices in the depicted example. Four removable grip devices 24 are shown, with two grip devices 24 located at the front of gripping pad 18, and two grip devices 24 located at the rear of gripping pad 18. Grip devices 24 are integrated into gripping pad 18. Two grip devices 24 are integrated in second gripping pad 26 which is located at approximately the heel portion of shoe 12. Finally, toe area 32 is seen accommodating the toe region of shoe 12.

Figure 6:
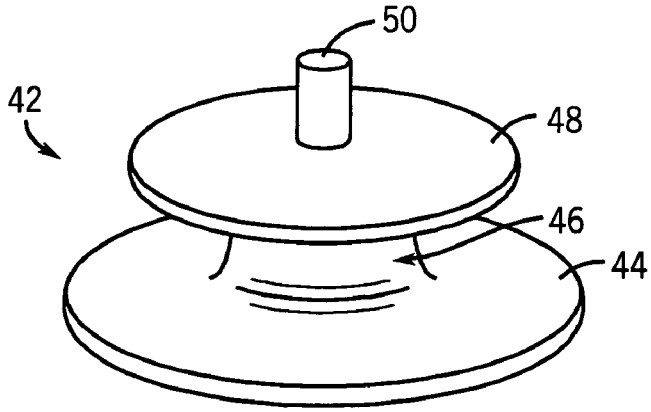
FIG. 6 illustrates an example of a removable grip device for use in an anti-slip overshoe.

Turning to FIG. 6, an example of a grip device 24 is depicted. Spike 42 includes a series of two interconnected, solid flanges. As shown, large flange 44 is located towards the bottom of spike 42. The bottom of flange 44 can be flat, similar to the top surface of overshoe 10. Gap 46 separates and connects large flange 44 with small flange 48. The top of small flange 48 forms the surface of spike 42 which engages a slippery surface. Tip 50 is seen integrated into the center of spike 42. Tip 50 can extend outwards from spike 42 into a slippery surface to provide additional traction. Tip 50, again can be made of a durable material such as carbide or similar metallic material. Spike 42 can be constructed using an injection molding technique which is similar to those described previously. Tip 50 can be inserted in the hot, molten polymer. As the polymer hardens, tip 50 is securely held in place in the center of spike 42.

To use spike 42 as a removable grip device 24, a wearer inserts the spike 42 in a receiving bore located in first gripping pad 18 or second gripping pad 26. The material of gripping pad 18 or gripping pad 26 then seats in gap 46 between large flange 44 and small flange 48. Seating spike 42 in gap 46 retains spike 42 in a stationary position with respect to the body of overshoe 10 while allowing spike 42 to be removed for replacement or for safety.

Overshoe 10 can have greater thickness in critical areas. Other anti-slip overshoes have a thickness that is essentially uniform throughout. Having a uniform thickness may simplify mass production of prior art overshoes, but the durability of prior art overshoes are compromised. The longevity of overshoe 10 can be improved by adding extra material thickness at key areas. For instance, the rearward portion of overshoe 10 can have thicker material than the frontward portion. In addition, the areas around grip devices 24 can be reinforced with additional material.

While one or more embodiments of the present invention have been illustrated in detail, the skilled artisan will appreciate that modifications and adaptations to those embodiments may be made without departing from the scope of the present invention as set forth in the following claims.

What is claimed is:

1. An anti-slip overshoe for fitting over a shoe sole, comprising:

an outer band having a front portion and a heel portion, the outer band being made with stretchable material to conform to the shoe sole when stretched, the outer band being substantially flat and having a form factor smaller than the shoe sole when the stretchable material is in a relaxed state, the outer band being contoured such that the front portion is wider than the heel portion;

a first gripping pad disposed interior to the outer band, the first gripping pad including:

a gripping ridge integrated in the first gripping pad for providing traction, a ridge space integrated in the first gripping pad for providing traction, and a first removable grip device integrated into the first gripping pad for providing traction, the first removable grip device having first and second separable flanges, the first flange being larger than the second flange for frictionally seating the first removable grip device in a bore formed in the first gripping pad, the second flange including a tip for gripping the ground in harsh conditions; and a web structure connecting the first gripping pad to the outer band.

2. The anti-slip overshoe of claim 1, further including a second gripping pad connected to the outer band by the web structure for providing traction.

3. The anti-slip overshoe of claim 2, wherein the second gripping pad includes a second removable grip device integrated into the second gripping pad for providing traction, the second removable grip device having first and second separable flanges, the first flange being larger than the second flange, the second flange including a tip for gripping the ground in harsh conditions.

4. The anti-slip overshoe of claim 1, wherein the gripping ridge varies in height, width or depth for providing traction.

5. The anti-slip overshoe of claim 1, wherein the gripping ridge includes a trough structure to channel away moisture from the first gripping pad.

6. The anti-slip overshoe of claim 1, wherein the outer band is made with polymers or thermoplastic resins.

7. The anti-slip overshoe of claim 1, wherein the tip is made with carbide material.

8. An anti-slip overshoe for fitting over a shoe sole, comprising:

an outer band having a front portion and a heel portion, the outer band being made with stretchable material to conform to the shoe sole when stretched, the outer band being substantially flat and having a form factor smaller than the shoe sole when the stretchable material is in a relaxed state, the outer band being contoured such that the front portion is wider than the heel portion;

a first gripping pad disposed interior to the outer band, the first gripping pad including, a gripping ridge integrated in the first gripping pad for providing traction, and a first spike integrated into the first gripping pad for providing traction, the first spike having first and second separable flanges, the first flange being larger than the second flange for seating the first spike in a bore formed in the first gripping pad; and a web structure connecting the first gripping pad to the outer band.

9. The anti-slip overshoe of claim 8, further including a second gripping pad connected to the outer band by the web structure for providing traction.

10. The anti-slip overshoe of claim 9, wherein the second gripping pad includes a second spike integrated into the second gripping pad for providing traction, the second spike having first and second separable flanges, the first flange being larger than the second flange.

11. The anti-slip overshoe of claim 8, wherein the gripping ridge varies in height, width or depth for providing traction.

12. The anti-slip overshoe of claim 8, wherein the gripping ridge includes a trough structure to channel away moisture from the first gripping pad.

13. The anti-slip overshoe of claim 8, wherein the first spike includes a carbide tip for gripping the ground in harsh conditions.

14. The anti-slip overshoe of claim 8, further including a ridge space integrated in the first gripping pad for providing traction.

15. An anti-slip overshoe for fitting over a shoe sole, comprising:

a contoured outer band having a front portion and a heel portion, the contoured outer band being made with stretchable material to conform to the shoe sole when stretched, the contoured outer band being substantially flat and having a form factor smaller than the shoe sole when the stretchable material is in a relaxed state, the front portion of the contoured outer band being wider than the heel portion;

a first gripping pad disposed interior to the contoured outer band for providing traction, the first gripping pad including a first spike integrated into the first gripping pad for providing traction, the first spike having first and second separable flanges, the first flange being larger than the second flange for seating the first spike in a bore formed in the first gripping pad; and a web structure connecting the first gripping pad to the outer band.

16. The anti-slip overshoe of claim 15, further including a second gripping pad connected to the outer band by the web structure for providing traction.

17. The anti-slip overshoe of claim 16, wherein the second gripping pad includes a second spike integrated into the second gripping pad for providing traction, the second spike having first and second separable flanges, the first flange being larger than the second flange.

18. The anti-slip overshoe of claim 15, further including a gripping ridge integrated in the first gripping pad for providing traction.

19. The anti-slip overshoe of claim 18, wherein the gripping ridge varies in height, width or depth for providing traction.

20. The anti-slip overshoe of claim 18, wherein the gripping ridge includes a trough structure to channel away moisture from the first gripping pad.

21. A method of making an anti-slip overshoe, comprising:

providing a contoured outer band having a front portion and a heel portion, the contoured outer band being made with stretchable material to conform to the shoe sole when stretched, the contoured outer band being substantially flat and having a form factor smaller than the shoe sole when the stretchable material is in a relaxed state, the front portion of the contoured outer band being wider than the heel portion;

providing a first gripping pad disposed interior to the contoured outer band for providing traction, the first gripping pad including a first spike integrated into the first gripping pad for providing traction, the first spike having first and second separable flanges, the first flange being larger than the second flange for seating the first spike in a bore formed in the first gripping pad; and interconnecting the first gripping pad to the outer band with a web structure.

22. The method of claim 21, further including providing a second gripping pad connected to the outer band by the web structure for providing traction.

23. The method of claim 21, further including a gripping ridge integrated in the first gripping pad for providing traction.

24. The method of claim 23, wherein the first gripping ridge includes a trough structure to channel away moisture from the first gripping pad.

25. The method of claim 23, wherein the gripping ridge varies in height, width or depth for providing traction.

* * * * *